United States Patent [19]

Saxer

[11] 4,381,616

[45] May 3, 1983

[54] INTERNALLY ILLUMINATED ROTATABLE PICTORIAL MENU DISPLAY

[76] Inventor: Norman K. Saxer, 5700 Broadmoor, Mission, Kans. 66202

[21] Appl. No.: 301,386

[22] Filed: Sep. 11, 1981

[51] Int. Cl.[3] ..... G09F 13/00

[52] U.S. Cl. ..... 40/502; 40/503

[58] Field of Search ..... 40/502, 503, 506

[56] References Cited

U.S. PATENT DOCUMENTS

| | | | |
|---|---|---|---|
| 613,538 | 11/1898 | Varney | 40/506 |
| 1,706,386 | 3/1929 | Killmnick | 40/502 |
| 3,273,271 | 9/1966 | Werner | 40/502 |
| 3,345,766 | 10/1967 | Timlin | 40/502 |
| 3,383,785 | 5/1968 | Werner | 40/502 |
| 4,002,022 | 1/1977 | Lopez | 40/502 |

*Primary Examiner*—Gene Mancene
*Assistant Examiner*—Wenceslao J. Contreras
*Attorney, Agent, or Firm*—Marvin S. Towsend

[57] ABSTRACT

A menu display is provided having a plurality of independent, rotatable exhibitor units. The exhibitor units are placed edge to edge to form an exhibiting surface. Each exhibitor unit includes a plurality of pictorial display panels which form a prism-like housing in which is contained a light source. The light source is preferably coaxial with the axis of rotation of the exhibitor unit. The exhibitor units may rotate upon a tongue and groove structure or upon roller bearings. Display panels not in the exhibiting surface are stored in the exhibitor unit. A pictorial display may be fixed to the display panel housing using electrostatic attraction provided by plastic sheets having electrostatic properties. An elevated embodiment of the menu display is provided with a recessed, elevated base. The recessed base allows changing of insertable exhibitor sheets from below a display assembly without the use of a ladder. Opaque flanges may be attached to the edges of adjacent exhibitor units to prevent stray light from emerging from behind the exhibitor surface between a clearance between adjacent exhibitor units.

10 Claims, 5 Drawing Figures

INTERNALLY ILLUMINATED ROTATABLE PICTORIAL MENU DISPLAY

FIELD OF THE INVENTION

The invention relates to an illuminated menu display for fast food restaurants and the like which exhibits prices, written descriptions, and pictures of menu items.

BACKGROUND OF THE INVENTION

Illuminated menu displays which exhibit pictures, written descriptions, and price information of menu items are known. Customarily, in order to change the exhibited items, display panels or signs must be removed and replaced with other panels. Storage space must be set aside in the restaurant for retaining display panels which are not in use. Panels not in use are subject to being misplaced or damaged in storage. Often menu displays are fixed at an elevated position so as to be readily visible to patrons. The elevated level of the display panels presents a problem when the panels are to be changed. Often a ladder must be used to aid in changing the display.

Methods of fixing display panels on the menu display currently include employing connectors such as screws, frames, clamps, etc. There is no inherent attraction between the display panel itself and the menu display.

SUMMARY OF THE INVENTION

In view of the deficiencies and inadequacies of the illuminated menu displays described above, it is an object of the invention to provide a novel menu display which itself stores panels not being displayed thereby precluding need for separate storage space to be set aside.

Another object of the invention is to provide a menu display having features lending to relative ease in changing panels that are displayed without removal and replacement of the non-displayed panels.

An additional object is to provide a menu display to which display panels are fixed by an inherent attraction between the display panel itself and the menu display.

Still another object of the invention is to provide a menu display with elevated display panels that can be changed without the aid of a ladder.

These and other objects are accomplished by the invention as described below.

The invention is an internally illuminated, changeable exhibitor apparatus comprising a plurality of independent display units placed edge to edge to form an exhibiting surface. Each display unit is independently rotatable and includes a plurality of display panels which together form a housing. A light source is placed within each display panel housing, preferably along the axis of rotation of the display unit. Only one display panel of an individual display unit faces the exhibiting surface at a given time. The display panels not exhibited are simply retained in the display unit until they are needed.

Preferably, three display panels are used to form a hollow, prism-like housing for the rotatable display unit.

The means for rotating the display units can take a variety of forms including roller bearings and a complementary circular tongue and groove.

The light source may remain stationary as the housing rotates about it. Alternatively, both the light source and housing can rotate together when the exhibiting panel is changed.

A preferred exhibiting panel has a structure wherein there is an inherent attraction between the displayed item itself and the exhibiting panel. To accomplish this, an exhibiting panel may include a transparent support sheet to which a laminate is fixed by electrostatic attraction. The laminate includes a transparent electrostatic sheet such as Mylar and a translucent picture such as a printparency. The support sheet may be made of Plexiglas.

In order to permit changing of the contents of a particular exhibiting panel, especially if the display is at an elevated position, an exhibiting panel may be comprised of an assembly having a transparent rear panel, a transparent front panel spaced from the rear panel, and a slidably insertable exhibitor sheet. The display unit having such an exhibiting assembly is supported by an elevated base whose forward edge is recessed behind the exhibiting assembly. With this structure, employment of a ladder would not be needed to aid in removing and replacing an insertable exhibitor sheet from the exhibiting assembly. As long as the bottom of the exhibiting assembly is within reach of a worker, an exhibitor sheet can be slid out the bottom of the exhibiting assembly, and a replacement can be slid back into the assembly without needing a ladder.

In order to prevent stray light from being transmitted from the rear of the exhibiting surface between individual display units, opaque flange elements can be affixed to adjacent edges of the exhibiting panels. The opaque flanges provide the appearance of a dark background upon which the exhibiting panels are illuminated.

The novel features characteristic of the invention as to its organization, method of operation, and application will best be understood by the description presented below when read in connection with the accompanying drawing. Although the description presented below relates especially to the embodiments of the invention illustrated in the drawing, this description is not intended to limit the scope of the invention which is defined in the claims.

DETAILED DESCRIPTION OF THE INVENTION

Figure 1:
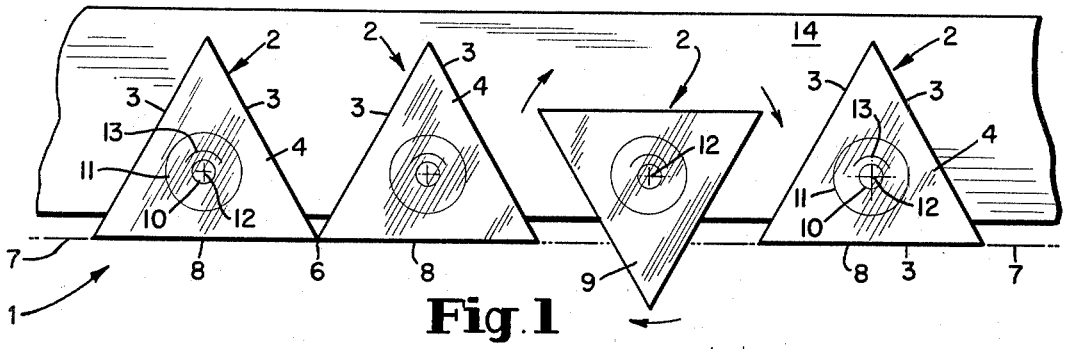
FIG. 1 is a top view of a plurality of independently rotatable exhibitor units forming an apparatus of the invention.

With reference to FIG. 1, internally illuminated changeable exhibitor apparatus 1 is comprised of a plurality of independent exhibitor units 2 being edge to edge (shown at 6) and forming an exhibiting surface 7 at the front of the apparatus. Each exhibitor unit 2 has a plurality of display panels 3 which together form a housing 4. Of the display panels 3 forming the housing 4, one panel 3 is oriented to be a part of the exhibiting surface 7. The display panel 3 which is part of the exhibiting surface 7 is the exhibiting panel 8. Each exhibitor unit rests on base 14.

Figure 2:
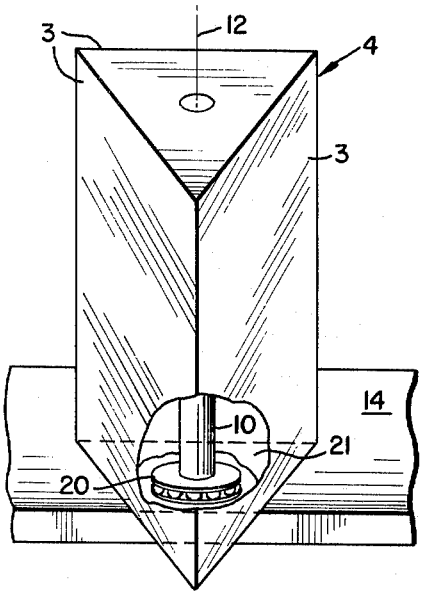
FIG. 2 is a prism-like housing formed from three display panels.

Display panels 3 serving as exhibiting panels 8 in the exhibiting surface 7 are easily changed simply by rotating an exhibitor unit, e.g. exhibitor unit 9 which is rotated clockwise as indicated by the arrows. Means for rotating the exhibitor units 2 may assume a variety of forms. In FIG. 1, the rotating means are indicated by circular tongue and groove 11. In FIG. 2, the rotating means are shown to be roller bearings 20 on exhibitor unit bottom plate 21.

The exhibiting panels 8 are illuminated by light source 10. Reflector 13 can be used to direct the light forward to illuminate the exhibiting panels 8 with increased intensity. The exhibitor units 2 rotate around axis of rotation 12. As shown in FIG. 1, the light source 10 is coaxial with the axis of rotation 12. For this purpose, the light source 10 can be a fluorescent tube coaxial with the axis of rotation 12.

The light source 10 can remain stationary as the housing 4 rotates around it. Alternatively, the light source 10 and the housing 4 can rotate together around the axis of rotation 12.

In FIG. 2, housing 4 is shown to be a prism-like structure formed from three display panels 3. Light source 10 is coaxial with axis of rotation 12. Roller bearings 20 are used for rotating the housing 4 around the axis of rotation 12.

Figure 3:
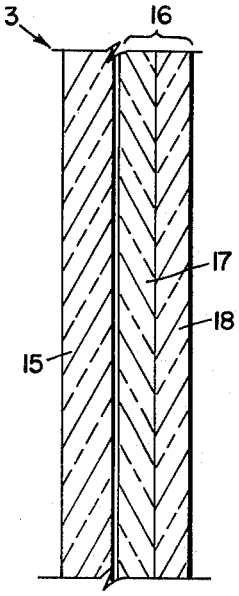
FIG. 3 is a cross-section of one embodiment of a display panel of the invention.

In FIG. 3, a particular embodiment of a display panel 3 of the invention is shown. Display panel 3 is comprised of a translucent support sheet 15 and a laminate 16. The laminate 16 is comprised of a transparent electrostatic sheet 17 and a translucent picture sheet 18. The translucent support sheet 15 may be made from Plexiglass which is non-conductive and serves to retain an electrostatic charge. The electrostatic sheet 17 may be made from Mylar which has the properties of retaining a large electrostatic charge for a long period of time. The picture sheet 18 may be a printparency.

Because of the strong and lasting electrostatic attraction between support sheet 15 and picture sheet 18 through the intermediate electrostatic sheet 17, fixing the picture onto the display panel may be accomplished without the need for mechanical fasteners.

In FIGS. 1, 2 and 3 embodiments of the invention are shown in which the apparatus of the invention may be used as a menu display in which display panels which are not currently in use as exhibiting panels in the exhibiting surface are readily stored out of sight in the exhibitor unit. No separate storage space need be set aside for their storage. The method of changing an exhibiting panel is very simple and easy to effect. The housing formed from the display panels is simply rotated around the axis of rotation. Fixing a picture sheet onto a display panel may be accomplished simply by electrostatic attraction without the need for mechanical fasteners.

Figure 4:
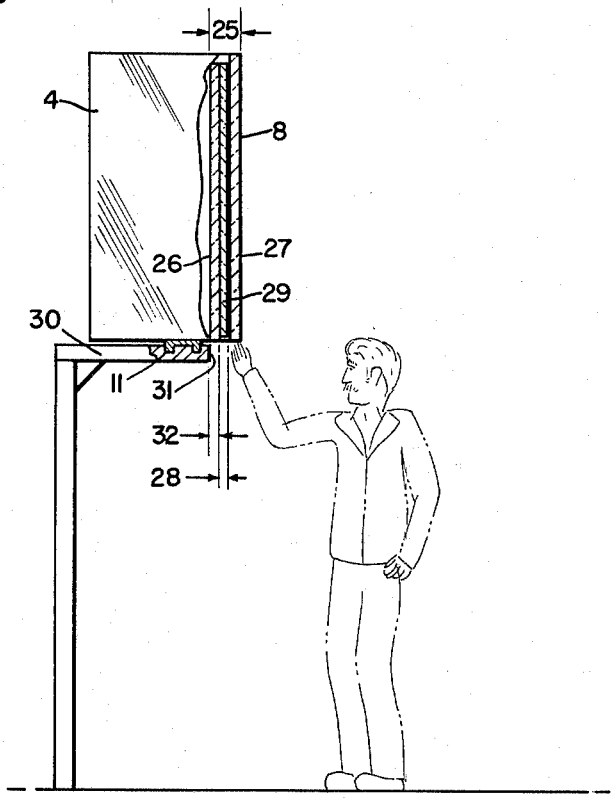
FIG. 4 is a view of an elevated embodiment of the invention changeable from below the exhibitor units.

In FIG. 4 another aspect of the invention is shown. An exhibiting panel assembly 25 is comprised of a rear translucent panel 26, a front transparent panel 27 which is spaced a distance 28 from the rear panel 26, and a removable translucent exhibiting sheet insert 29 which is slid between the rear panel 26 and the front panel 27. The exhibiting panel assembly 25 is supported by elevated base 30 which may be more than the height of a person above floor level.

The front edge 31 of the base 30 is recessed distance 32 behind the front of rear panel 26. On account of the recessed distance 32, base 30 does not obstruct changing insert sheet 29 from below the exhibiting panel assembly 25. In this way, it is unnecessary for a person changing an insert sheet 29 to employ a ladder. To change a slidable insert 29, one need only reach up, move aside a retaining clip that may be keeping the insert 29 from sliding out of the assembly 25, letting the insert slide out of the assembly, replacing the insert, and replacing the retaining clip in the retaining position. It is understood, of course, that a plurality of exhibiting panel assemblies 25 are employed together to form a housing 4 as disclosed in FIGS. 1 and 2.

Figure 5:
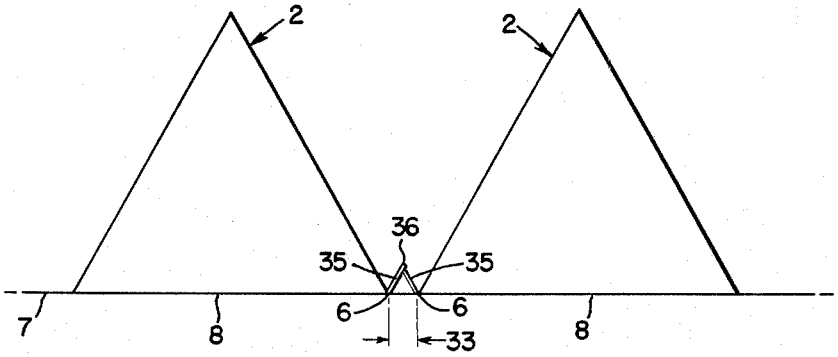
FIG. 5 shows light shields at the edges of adjacent exhibitor units.

In FIG. 5 another feature of the invention is disclosed. When exhibitor units 2 are edge to edge (shown at 6), there is the possibility that a clearance 33 will occur. Though the clearance may be relatively small, an undesirable effect may result. Stray light from behind the exhibiting surface 7 may emerge from the clearance 33 between the edges 6 of the exhibitor units 2. In order to prevent stray light from passing through the clearance 33, opaque flanges 35 are attached to the edges 6 of the exhibitor units 2. Flanges 35 are oriented so that they do not interfere with the rotation of the exhibitor units 2. Opaque flanges 35 are oriented so that they overlap thereby covering up the clearance 33 and preventing stray light from emerging onto the exhibiting surface 7 from behind the exhibiting surface 7 between the clearance 33. Overlap of flanges 35 is shown at element 36.

The foregoing description of the preferred embodiments of the invention has been presented for purposes of illustration and description. It is not intended to be exhaustive or to limit the invention to the precise form disclosed. Obvious modifications and variations are possible in light of the above teaching, for example: the exhibitor units may be housed in a box having the inside painted black to reduce stray light; four or more display panels can be used to form the exhibitor unit housing; rotating means may be wheeled legs with a track for the wheels; and the exhibiting panels may be illuminated by electroluminescent panels. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An internally illuminated changeable exhibitor apparatus, comprising:

a plurality of independent exhibitor units, each of said units having a plurality of display panels forming a housing, one of said display panels in an exhibiting orientation providing an exhibiting panel, the plurality of said exhibiting panels being edge to edge forming an exhibiting surface, said exhibiting panels having overlapping opaque flange means connected to the adjacent edges of said exhibiting panels for blocking stray light from being transmitted from the rear of said exhibiting surface between said independent exhibitor units;

a light source within each exhibitor unit for internally illuminating said exhibiting panels; and means for rotating each exhibitor unit for selecting a display panel to be an exhibiting panel in said exhibiting surface.

2. An apparatus as described in claim 1 wherein said light source coincides with the axis of rotation of said rotatable exhibitor unit.

3. An apparatus as described in claim 2 wherein said exhibitor unit is rotatable around said light source which is stationary.

4. An apparatus as described in claim 1 wherein three of said display panels form a hollow, prism-like housing.

5. An internally illuminated changeable exhibitor apparatus, comprising:

a plurality of independent exhibitor units, each of said units having a plurality of display panels forming a housing, one of said display panels in an exhibiting orientation providing an exhibiting panel, the plurality of said exhibiting panels being edge to edge forming an exhibiting surface;

a light source within each exhibitor unit for internally illuminating said exhibiting panels; and means for rotating each exhibitor unit for selecting a display panel to be an exhibiting panel in said exhibiting surface;

wherein a display panel is comprised of:

a translucent support sheet; and a laminate of a transparent electrostatic sheet and a translucent picture sheet wherein said electrostatic sheet fixes said laminate to said support sheet by electrostatic attraction.

6. An apparatus as described in claim 5 wherein:

said transparent support sheet is made from Plexiglas; and in said laminate, said transparent electrostatic sheet is made from Mylar; and said translucent picture sheet is a printparency.

7. An apparatus as described in claim 1 wherein said means for rotating said exhibitor units are roller bearings.

8. An apparatus as described in claim 1 wherein said means for rotating said exhibitor units are complementary tongue and groove means.

9. An apparatus as described in claim 1 having an exhibiting panel assembly, comprising:

a rear translucent panel;

a front transparent panel spaced from said rear panel; and a removable translucent exhibiting sheet insert which is slid between said rear panel and said front panel.

10. An apparatus as described in claim 9 further including an elevated base having an edge recessed with respect to said exhibiting panel assembly allowing slidable removal and replacement of said exhibiting sheet insert from below the level of said base.

* * * * *